US011933295B2

(12) United States Patent
Bauer et al.

(10) Patent No.: US 11,933,295 B2
(45) Date of Patent: Mar. 19, 2024

(54) TAPERED SHAFTS FOR FLUID PUMPS

(71) Applicant: General Electric Company, Schenectady, NY (US)

(72) Inventors: Bradley Alan Bauer, Evendale, OH (US); Paul T. Sudkamp, Evendale, OH (US); Michael J. Halligan, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/833,591

(22) Filed: Jun. 6, 2022

(65) Prior Publication Data

US 2023/0392595 A1 Dec. 7, 2023

(51) Int. Cl.
*F04C 15/00* (2006.01)
*F04C 2/16* (2006.01)

(52) U.S. Cl.
CPC ..... *F04C 15/0088* (2013.01); *F04C 2/16* (2013.01); *F04C 2240/20* (2013.01); *F04C 2240/50* (2013.01); *F04C 2240/60* (2013.01)

(58) Field of Classification Search
CPC .... F04C 15/0088; F04C 2/16; F04C 2240/20; F04C 2240/50; F04C 2240/60
See application file for complete search history.

(56) References Cited

U.S. PATENT DOCUMENTS

| | | | | |
|---|---|---|---|---|
| 2,840,399 | A * | 6/1958 | Harless | F16D 1/092 29/898.07 |
| 2,870,719 | A * | 1/1959 | Murray | F16C 33/04 384/208 |
| 3,003,425 | A * | 10/1961 | Flowers | F04C 2/086 418/135 |
| 3,785,023 | A | 1/1974 | Harbottle | |
| 5,215,430 | A | 6/1993 | Brown | |
| 6,095,766 | A | 8/2000 | Brown | |
| 6,200,034 | B1 | 3/2001 | Miller | |
| 6,769,413 | B2 | 8/2004 | Ishimoto | |
| 2002/0164102 | A1 | 11/2002 | Kurtz | |
| 2005/0254936 | A1 | 11/2005 | Hayakawa et al. | |
| 2012/0207626 | A1 * | 8/2012 | Dalton | F04C 2/18 417/253 |
| 2021/0262465 | A1 * | 8/2021 | Blomkvist | F04C 2/3442 |

FOREIGN PATENT DOCUMENTS

DE 102020124392 A1 * 3/2022 ..... F04C 15/0061

OTHER PUBLICATIONS

English Machine Translation of DE102020124392A1 via USTPO PE2E translation (Year: 2022).*

* cited by examiner

*Primary Examiner* — Dominick L Plakkoottam
*Assistant Examiner* — Paul W Thiede
(74) *Attorney, Agent, or Firm* — HANLEY, FLIGHT & ZIMMERMAN, LLC

(57) ABSTRACT

Tapered shafts for fluid pumps are disclosed. An example apparatus to pump fluid includes a gear, and a shaft including a taper to define a first portion of the shaft having a first thickness and a second portion of the shaft having a second thickness less than the first thickness, the second portion of the shaft between the gear and the first portion of the shaft.

10 Claims, 6 Drawing Sheets

TAPERED SHAFTS FOR FLUID PUMPS

FIELD OF THE DISCLOSURE

This disclosure relates generally to fluid pumps for gas turbine engines and, more particularly, to particularly shaped shafts for fluid pumps.

BACKGROUND

In recent years, fuel pumps have increased a pressure at which fuel is driven. Specifically, higher pressure fuel injections can be advantageous for combustion.

BRIEF DESCRIPTION OF THE DRAWINGS

The figures are not to scale. In general, the same reference numbers will be used throughout the drawing(s) and accompanying written description to refer to the same or like parts.

DETAILED DESCRIPTION

Figure 1:
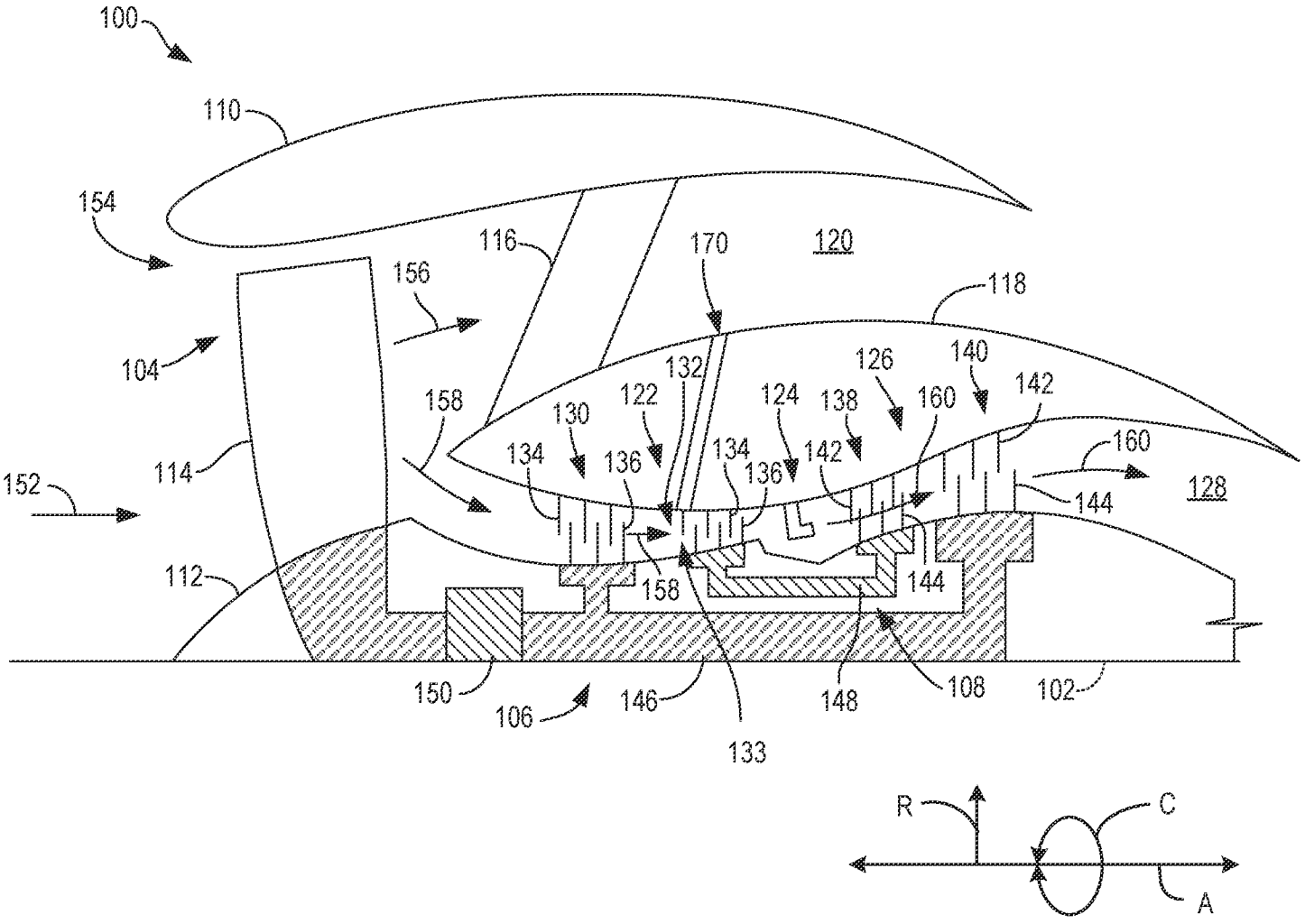
FIG. 1 (PRIOR ART)
FIG. 1 illustrates a schematic cross-sectional view of a prior art example of a gas turbine.

As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name. As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin.

As used herein in the context of describing the position and/or orientation of a first object relative to a second object, the term "substantially parallel" encompasses the term parallel and more broadly encompasses a meaning whereby the first object is positioned and/or oriented relative to the second object at an absolute angle of no more than five degrees (5°) from parallel. For example, a first axis that is substantially parallel to a second axis is positioned and/or oriented relative to the second axis at an absolute angle of no more than five degrees (5°) from parallel.

As used herein in the context of describing the position and/or orientation of a first object relative to a second object, the term "substantially perpendicular" encompasses the term perpendicular and more broadly encompasses a meaning whereby the first object is positioned and/or oriented relative to the second object at an absolute angle of no more than five degrees (5°) from perpendicular. For example, a first axis that is substantially perpendicular to a second axis is positioned and/or oriented relative to the second axis at an absolute angle of no more than five degrees (5°) from perpendicular.

The terms "forward" and "aft" refer to relative positions within a gas turbine engine or vehicle and refer to the normal operational attitude of the gas turbine engine or vehicle. For example, with regard to a gas turbine engine, forward refers to a position closer to an engine inlet and aft refers to a position closer to an engine nozzle or exhaust.

The terms "upstream" and "downstream" refer to the relative direction with respect to a flow in a pathway. For example, with respect to a fluid flow, "upstream" refers to the direction from which the fluid flows, and "downstream" refers to the direction to which the fluid flows.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

As used herein in the context of a change in thickness, the term "taper" covers a reduction in thickness from a first area of a shaft to a second area of the shaft such that the reduction in thickness can be defined by any geometry. Specifically, the "taper" in a shaft defines a transition area between different thicknesses in the shaft that can be defined by any surface contour (e.g., any shape, any slope, etc.).

Gas turbines produce power and/or mechanical drive for aeronautics, marine applications, gear boxes, off-shore power generators, terrestrial power plants, etc. The gas turbines can utilize fuel (e.g., jet fuel) to convert thermal and chemical energy to mechanical energy via combustion. When the fuel is induced into a combustor at higher pressures, the combustion can produce an increased amount of mechanical energy as more of the thermal energy produced via combustion is converted to mechanical energy. Accordingly, the increased mechanical energy drives turbine blades at a faster rate and, in turn, drives spools in connection with the turbine blades as well as fan blades and/or rotor blades in the compressor at a faster rate to produce more mechanical drive. Additionally, inducing the fuel into the combustor with higher pressures can increase a fuel efficiency of the gas turbine as well as reduce emission of pollutants.

However, fuel pumps that drive and pressurize the fuel limit the pressure at which the fuel can be injected into the combustor. Specifically, when the fuel reaches higher pressures, the pressure can damage the fuel pump. For example, the pressure can cause certain components within the pump to deform, which can cause a failure and/or a reduced pressure output for the fuel pump. Specifically, when a gear, or another rotating element (e.g., a screw, a vane, etc.), encounters fuel at higher pressures (e.g., pressures greater than 2,000 pounds-per-square-inch (PSI)), the pressure can cause a journal (e.g., a portion of a gear shaft positioned in a bearing) of the gear to bend. In turn, the bending of the journal can cause the journal to contact the bearing positioned around the journal, resulting in metal-on-metal contact. Accordingly, the contact can wear down the journal and/or prevent the journal from rotating in the bearing. As a result, the bending of the journal in response to the gear encountering higher pressures can cause a failure in a gear stage of the fuel pump.

Example tapered shafts (e.g., journals) for fluid pumps are disclosed herein. An example fluid pump disclosed herein includes a shaft and a rotating element (e.g., a gear, a vane, a screw, etc.) extending radially outward from the shaft. Specifically, the rotating element is utilized to move fluid as in a rotary positive displacement pump. Further, the shaft includes a taper to define a first portion of the shaft having a first thickness and a second portion of the shaft having a second thickness smaller than the first thickness.

The first and second portions of the shaft are at least partially positioned in a bearing that supports the shaft and, in turn, the rotating element. For example, the bearing can be a plain bearing (e.g., a journal bearing, a sliding contact bearing, a bearing without rotating elements, etc.) having a uniform inner diameter. Accordingly, the first and second portions of the shaft at least partially form a journal of the rotating element (e.g., a portion of a shaft positioned in a bearing). To enable the shaft to rotate within the bearing, the fluid pump can include a fluid between the shaft and bearing such that the fluid can provide lubrication. The first thickness enables the first portion of the shaft to be positioned closer to a surface of the bearing for support. On the other hand, the second thickness enables the second portion of the shaft to be separated from the surface of the bearing by an increased distance relative to the first portion. Specifically, the second portion of the shaft is positioned between the rotating element and the first portion. As such, the second thickness can help the second portion of the shaft avoid contact with the bearing in response to the rotating element encountering a deflection that causes deformation (e.g., bending, bowing, etc.) in the second portion of the shaft. Accordingly, the reduced thickness in the portion of the shaft located closer to the rotating element enables the rotating element to encounter increased loads (e.g., higher pressures) that can lead to displacement because the first portion of the shaft can still avoid contact with the bearing while encountering deformation (e.g., bending, bowing, etc.).

In some examples, projections or cogs of the rotating element can mesh with the projections or cogs of another rotating element such that the rotating elements transfer torque with each other and/or pump a fluid. Further, the example fluid pump can include a casing at least partially around the rotating elements. As a result, the projections or cogs can develop a liquid seal with the casing that creates suction at an inlet. Specifically, as the rotating elements rotate, an outer perimeter of the projections or cogs moves proximate the casing and, in turn, fluid is trapped between the cogs as the cogs move toward a discharge outlet. Accordingly, the outer perimeter of the cogs can come out of contact with the casing near the discharge outlet to release the fluid and enable a pressure on a discharge side of the rotating element to build. Moreover, an engagement between the respective cogs of the rotating elements can block the fluid from flowing between the rotating elements back towards the inlet. As such, the rotating elements can produce high pressures on the discharge side. To account for potential deflection that the rotating element can encounter under the built up pressure, the reduced thickness in the second portion of the shaft can deform while remaining separated from the bearing. For example, the second thickness of the second portion of the shaft enables the second portion of the shaft to bend while avoiding contact with an end of the bearing proximate the rotating element. Thus, the reduced thickness in the second portion of the shaft increases a pressure that the rotating element can encounter during operations of the fuel pump.

Accordingly, by enabling the rotating element to encounter higher pressures, the shaft enables the fluid pump to drive the fluid at higher pressures. As such, the fluid pump can be utilized to pump fuel into a combustor at higher pressures, which enables a combustion reaction in the combustor to produce an increased amount of mechanical energy while also being more fuel efficient and reducing emissions.

Referring now to the drawings, FIG. 1 is a schematic cross-sectional view of the gas turbine 100 of FIG. 1. In the illustrated example, the gas turbine 100 is configured as a high-bypass turbofan engine. However, in alternative examples, the gas turbine 100 may be configured as a propfan engine, a turbojet engine, a turboprop engine, a turboshaft gas turbine engine, or any other suitable type of gas turbine engine.

In general, the gas turbine 100 extends along an axial centerline 102 and includes a fan 104, a low-pressure (LP) shaft 106, and a high pressure (HP) shaft 108 at least partially encased by an annular nacelle 110. More specifically, the fan 104 may include a fan rotor 112 and a plurality of fan blades 114 (one is shown) coupled to the fan rotor 112. In this respect, the fan blades 114 are circumferentially spaced apart and extend radially outward from the fan rotor 112. Moreover, the LP and HP shafts 106, 108 are positioned downstream from the fan 104 along the axial centerline 102. As shown, the LP shaft 106 is rotatably coupled to the fan rotor 112, thereby permitting the LP shaft 106 to rotate the fan 114. Additionally, a plurality of outlet guide vanes or struts 116 circumferentially spaced apart from each other and extend radially between an outer casing 118 surrounding the LP and HP shafts 106, 108 and the nacelle 110. As such, the struts 116 support the nacelle 110 relative to the outer casing 118 such that the outer casing 118 and the nacelle 110 define a bypass airflow passage 120 positioned therebetween.

The outer casing 118 generally surrounds or encases, in serial flow order, a compressor section 122, a combustor section 124, a turbine section 126, and an exhaust section 128. In some examples, the compressor section 122 may include a low-pressure (LP) compressor 130 of the LP shaft 106 and a high-pressure (HP) compressor 132 of the HP shaft 108 positioned downstream from the LP compressor 130 along the axial centerline 102. Each compressor 130, 132 may, in turn, include one or more rows of stator vanes 134 interdigitated with one or more rows of compressor rotor blades 136. As such, the compressors 130, 132 define a compressed air flow path 133 extending therethrough. Moreover, in some examples, the turbine section 126 includes a high-pressure (HP) turbine 138 of the HP shaft 108 and a low-pressure (LP) turbine 140 of the LP shaft 106 positioned downstream from the HP turbine 138 along the axial centerline 102. Each turbine 138, 140 may, in turn, include one or more rows of stator vanes 142 interdigitated with one or more rows of turbine rotor blades 144.

Additionally, the LP shaft 106 includes the low-pressure (LP) shaft 146 and the HP shaft 108 includes a high pressure (HP) shaft 148 positioned concentrically around the LP shaft 146. In such examples, the HP shaft 148 rotatably couples the turbine rotor blades 144 of the HP turbine 138 and the compressor rotor blades 136 of the HP compressor 132 such that rotation of the turbine rotor blades 144 of the HP turbine 138 rotatably drives the compressor rotor blades 136 of the HP compressor 132. As shown in the example of FIG. 1, the LP shaft 146 is directly coupled to the turbine rotor blades 144 of the LP turbine 140 and the compressor rotor blades 136 of the LP compressor 130. Furthermore, the LP shaft 146 is coupled to the fan 104 via a gearbox 150. In this respect, the rotation of the turbine rotor blades 144 of the LP turbine 140 rotatably drives the compressor rotor blades 136 of the LP compressor 130 and the fan blades 114.

The gas turbine 100 can generate thrust to propel an aircraft. More specifically, during operation, air (indicated by arrow 152) enters an inlet portion 154 of the gas turbine 100. The fan 104 supplies a first portion (indicated by arrow 156) of the air 152 to the bypass airflow passage 120 and a second portion (indicated by arrow 158) of the air 152 to the compressor section 122. The second portion 158 of the air 152 first flows through the LP compressor 130 in which the compressor rotor blades 136 therein progressively compress the second portion 158 of the air 152. Next, the second portion 158 of the air 152 flows through the HP compressor 132 in which the compressor rotor blades 136 therein continue to progressively compress the second portion 158 of the air 152. The compressed second portion 158 of the air 152 is subsequently delivered to the combustor section 124. In the combustor section 124, the second portion 158 of the air 152 mixes with fuel and burns to generate high-temperature and high-pressure combustion gases 160. Thereafter, the combustion gases 160 flow through the HP turbine 138 where the turbine rotor blades 144 of the HP turbine 138 extract a first portion of kinetic and/or thermal energy from the combustion gases 160. This energy extraction rotates the HP shaft 148, thereby driving the HP compressor 132. The combustion gases 160 then flow through the LP turbine 140 where the turbine rotor blades 144 of the LP turbine 140 extract a second portion of kinetic and/or thermal energy from the combustion gases 160. This energy extraction rotates the LP shaft 146, driving the LP compressor 130 and the fan 104 via the gearbox 150. The combustion gases 160 then exit the gas turbine 100 through the exhaust section 128.

Furthermore, in some examples, the gas turbine 100 defines a third-stream flow path 170. In general, the third-stream flow path 170 extends from the compressed air flow path 170 defined by the compressor section 122 to the bypass airflow passage 120. In this respect, the third-stream flow path 170 allows the second portion 158 of the compressed air from the compressor section 122 to bypass the combustor section 124. More specifically, in some examples, the third-stream flow path 170 may define a concentric or non-concentric passage relative to the compressed air flow path 170 downstream of one or more of the compressors 130, 132 or the fan 104. The third-stream flow path 170 may be configured to selectively remove the second portion 158 of compressed air from the compressed air flow path 170 via one or more variable guide vanes, nozzles, or other actuatable flow control structures.

As depicted therein, the gas turbine 100 defines an axial direction A, a radial direction R, and a circumferential direction C. In general, the axial direction A extends generally parallel to the axial centerline 102, the radial direction R extends orthogonally outward from the axial centerline 102, and the circumferential direction C extends concentrically around the axial centerline 102.

Figure 2:
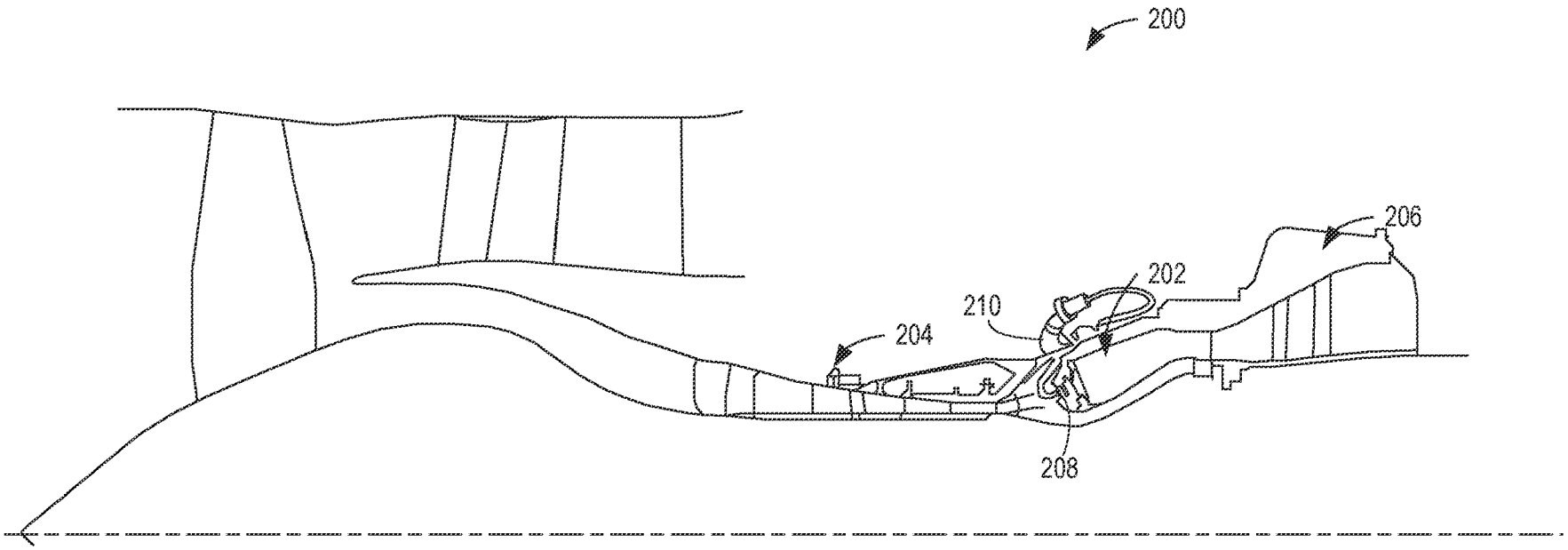
FIG. 2 illustrates a schematic cross-sectional view of an example gas turbine.

FIG. 2 illustrates a schematic cross-sectional view of an example gas turbine 200 in accordance with the teachings disclosed herein. In FIG. 2, the gas turbine 200 includes a combustor 202 between a compressor section 204 and a turbine section 206. In FIG. 2, the combustor 202 includes nozzles 208 in connection with a fuel circuit 210 (e.g., a fluid line, a fuel duct, etc.) that injects fuel (e.g., jet fuel) into the combustor 202. The fuel circuit 210 includes fuel metering components, such as valves, and is in connection with a fuel pump, as discussed further in association with FIGS. 3, 4, and 6.

Figure 3:
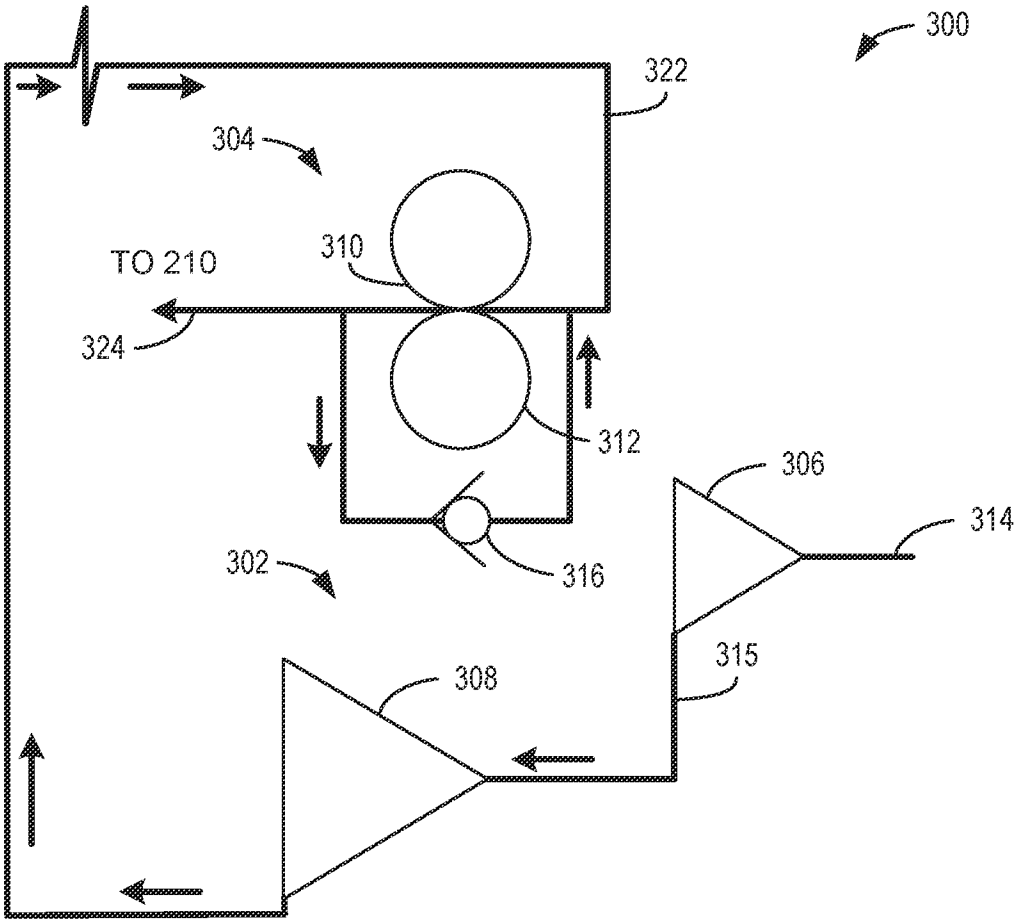
FIG. 3 is a schematic illustration of an example fuel pump that can be utilized with the example gas turbine of FIG. 2.

FIG. 3 is a schematic illustration of an example fuel pump 300 utilized with the gas turbine 200 of FIG. 2. Specifically, the fuel pump 300 is operatively coupled to the fuel circuit 210 (FIG. 2) such that the fuel pump 300 can pump fluid (e.g., fuel) towards the nozzles 208 (FIG. 2) and into the combustor 202 (FIG. 2).

In the illustrated example of FIG. 3, the fuel pump 300 includes a low-pressure section 302 and a high-pressure section 304. Specifically, the low-pressure section 302 includes a centrifugal pump that increases a pressure of the fuel. Further, the high-pressure section 304 is downstream of the low-pressure section 302 and includes a rotary positive displacement pump that further increases the pressure of the fuel, as discussed in further detail below.

In FIG. 3, the fuel pump 300 includes a first impeller 306 (e.g., a low-pressure impeller) and a second impeller 308 (e.g., a high-pressure impeller) in the low-pressure section 302. In FIG. 3, the first impeller 306 and the second impeller 308 are mounted on a drive shaft (not shown) that extends through the low-pressure section 302 and the high-pressure section 304. In addition, the fuel pump 300 includes a first gear 310 (e.g., a first rotating element) extending radially outward from a first gear shaft (e.g., a first journal) in the high-pressure section 304, as discussed further in association with FIGS. 5 and/or 6. Further, the fuel pump 300 includes a second gear 312 operatively coupled to (e.g., engaged with) the first gear 310. Similarly, the second gear 312 extends radially outward from a second gear shaft (e.g., a second journal) in the high-pressure section 304, as discussed further in association with FIGS. 5 and/or 6.

In some examples, the first gear shaft is operatively coupled to the drive shaft. Specifically, the first gear shaft includes a hollow interior with an interior surface that defines a spline interface. Further, the drive shaft extends through the hollow interior of the first gear shaft and couples to the first gear shaft via the spline interface. The drive shaft can be operatively coupled to an actuator and/or a gear system (not shown) that drives a rotation of the drive shaft and, in turn, the first impeller 306, the second impeller 308, and the first gear shaft. As such, the first gear 310 can rotate with the first impeller 306 and the second impeller 308. In turn, the first gear 310 can cause the second gear 312 and the second gear shaft to rotate.

In FIG. 3, in response to fuel entering the fuel pump 300 through an inlet 314, the first impeller 306 drives the fuel radially outward and increases a pressure of the fuel. The fuel pump 300 includes a conduit 315 between the first impeller 306 and the second impeller 308 that guides the fuel driven by the first impeller 306 towards the second impeller 308. In turn, the second impeller 308 again drives the fuel radially outward and increases the pressure of the fuel. Utilizing the second impeller 308 in addition to the first impeller 306 helps enable the fuel pump 300 to produce normal working pressures over 2,000 PSI, which is higher than a maximum working pressure of some known fuel pumps.

In FIG. 3, in response to being driven by the second impeller 308, the fuel can exit the low-pressure section 302 and flow through one or more auxiliary components before entering the high-pressure section 304 of the fuel pump 300. For example, the fuel can exit the low-pressure section 302 and flow through a strainer, a filter, a heat exchanger, etc., before returning to the fuel pump 300. In some examples, the fuel may not encounter the auxiliary component(s) when flowing from the low-pressure section 302 to the high-pressure section 304. Further, the first gear 310 and the second gear 312 form a rotary positive displacement pump that carries the fuel from an inlet 322 of the high-pressure section 304 towards an outlet 324 fluidly coupled to the fuel circuit 210 of FIG. 2.

Additionally, the high-pressure section 304 includes a pressure relief valve 316 that can enable fuel to re-route from the outlet side of the gears 310, 312 towards the inlet side. For example, the pressure relief valve 316 can be a passive valve that opens to enable the fuel to pass in response to encountering a pressure that may cause the gear shafts to contact associated bearings and cause a failure in the pump. To enable the gears 310, 312 to encounter increased pressures and react to more deflection without contacting associated bearings and causing a failure in the fuel pump 300, at least one of the shafts of the gears 310, 312 include reduced thicknesses proximate the gears 310, 312 to provide more space for the shafts to bend proximate the gears 310, 312, as discussed in further detail below. As such, the pressure relief valve 316 can remain closed against higher pressures, and the fuel pump 300 can produce an increased pressure output.

Although the fuel pump 300 of the illustrated example utilizes gears to implement a rotary positive displacement pump in the high-pressure section 304, it should be understood that any other rotating element that includes cogs to move fluid can form the rotary positive displacement pump in place of the gears 310, 312. For example, vanes and/or screws can extend radially outward from the first gear shaft and/or the second gear shaft to build up the pressure of the fuel in the high-pressure section 304 of the fuel pump 300.

Figure 4:
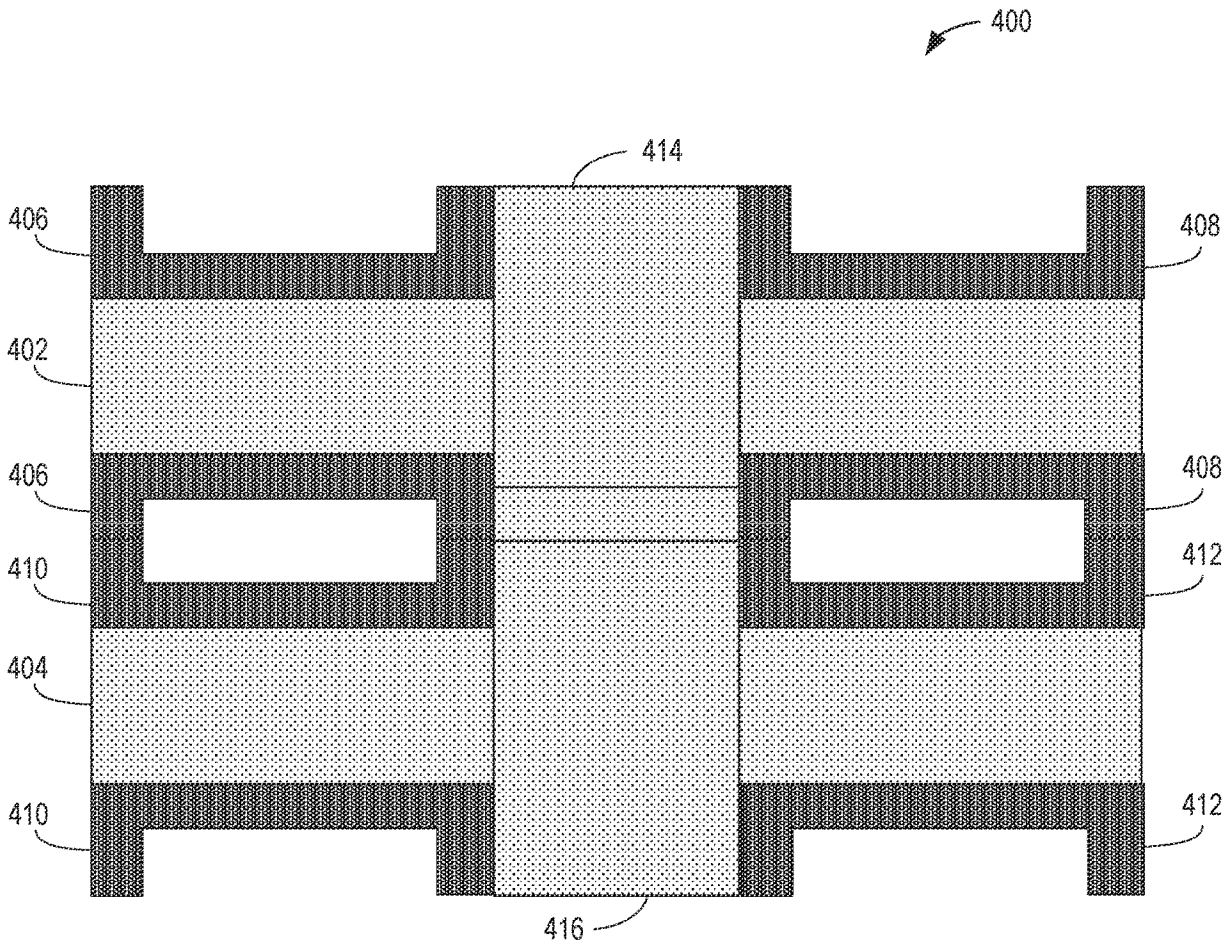
FIG. 4 (PRIOR ART)
FIG. 4 illustrates a magnified view of a prior art example gear system utilized in a fuel pump.

FIG. 4 illustrates an example prior art gear system 400 of a fuel pump. In known implementations, gear shafts 402, 404 include a uniform thickness to evenly spread a load being supported by bearings 406, 408, 410, 412 across a surface of the gear shaft. However, as mentioned above, higher pressures can cause gears 414, 416 to encounter deflection and, in turn, cause the associated shafts 402, 404 to encounter deformation in the form of bending by the respective gears 414, 416. As a result, the deformation in the shafts 402, 404 can cause the shafts 402, 404 to contact the bearings such that a rotation of the shaft is hindered, causing a failure in the gear system 400. Furthermore, as the rotation of the first gear shaft 402 can affect a drive shaft, the failure can propagate to other areas of the fuel pump.

Figure 5:
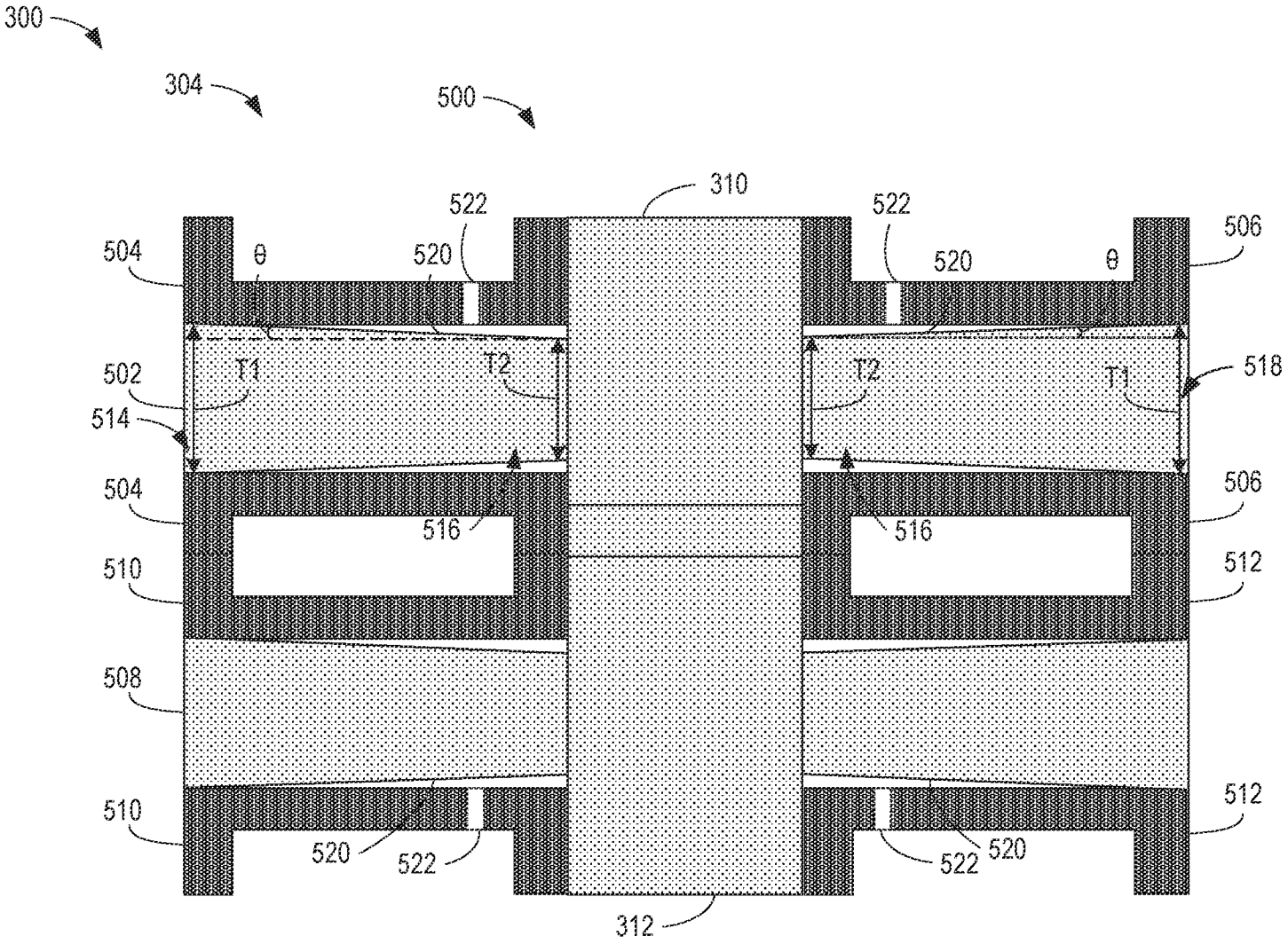
FIG. 5 illustrates a magnified view of an example gear system of the fuel pump of FIGS. 3-4 in accordance with the teachings disclosed herein.

FIG. 5 illustrates a magnified view of the high-pressure section 304 of the fuel pump 300 of FIG. 3. Specifically, FIG. 5 is an illustrative example gear system 500 of the high-pressure section 304 that forms a rotary positive displacement pump. In FIG. 5, an example first gear shaft 502 is positioned in a first bearing 504 (e.g., a first journal bearing, a first plain bearing, a first sliding contact bearing, etc.) and a second bearing 506 (e.g., a second journal bearing, a second plain bearing, a second sliding contact bearing, etc.). The first gear 310 extends radially outward from the first gear shaft 502. Accordingly, the first bearing 504 and the second bearing 506 support the first gear shaft 502 and, in turn, the first gear 310. Specifically, the first bearing 504 is a fixed bearing having a uniform inner diameter positioned around the first gear shaft 502 on a first side of the first gear 310 (e.g., a left side in the orientation of FIG. 5). Further, the second bearing 506 is a floating bearing having a uniform inner diameter positioned around the first gear shaft 502 on a second side of the first gear 310 (e.g., a side of the first gear 310 opposite the first side, a right side in the orientation of FIG. 5). That is, the first bearing 504 and the second bearing 506 are positioned concentrically around the first gear shaft 502 on opposite sides of the first gear 310.

Similarly, an example second gear shaft 508 is positioned in a third bearing 510 (e.g., a third journal bearing, a third plain bearing, a third sliding contact bearing, etc.) and a fourth bearing 512 (e.g., a fourth journal bearing, a fourth plain bearing, a fourth sliding contact bearing, etc.). Likewise, the second gear 312 extends radially outward from the second gear shaft 508. Accordingly, the third bearing 510 and the fourth bearing 512 support the second gear shaft 508 and, in turn, the second gear 312. The third bearing 510 is a fixed bearing having a uniform inner diameter positioned around the second gear shaft 508 on a first side of the second gear 312 (e.g., a left side in the orientation of FIG. 5), while the fourth bearing 512 is a floating bearing having a uniform inner diameter positioned around the second gear shaft 508 on a second side of the second gear 312 (e.g., a side of the second gear 312 opposite the first side, a right side in the orientation of FIG. 5). Thus, the third bearing 510 and the fourth bearing 512 are positioned concentrically around the second gear shaft 508 on opposite sides of the second gear 312.

Accordingly, portions of the first bearing 504, the second bearing 506, the third bearing 510, and the fourth bearing 512 are positioned between the first gear shaft 502 and the second gear shaft 508. In some examples, the first bearing 504 is coupled to the third bearing 510 between the first gear shaft 502 and the second gear shaft 508. Similarly, the second bearing 506 can be coupled to the fourth bearing 512 between the first gear shaft 502 and the second gear shaft 508. In FIG. 5, the first gear shaft 502, the first gear 310, the second gear shaft 508, and the second gear 312 are metallic. Similarly, the bearings 504, 506, 510, 512 are metallic. In FIG. 5, the first gear shaft 502 is substantially parallel to the second gear shaft 508.

In FIG. 5, the first gear 310 is engaged with (e.g., operatively coupled to) the second gear 312. During operations, the first gear 310 and the second gear 312 carry the fuel from the inlet 322 (FIG. 3) of the high-pressure section 304 towards the outlet 324 (FIG. 3). Specifically, as the gears 310, 312 rotate, cogs (e.g., teeth, projections, etc.) of the gears 310, 312 trap the fuel between the respective gears 310, 312 and a casing of the fuel pump positioned around the gears 310, 312. In turn, the cogs can carry the fuel being induced into the high-pressure section 304 towards the outlet 324. Further, an engagement between the cogs of the gears 310, 312 prevents the fuel from flowing back between the gears 310, 312 from an outlet side (e.g., a side of the gears 310, 312 oriented towards the outlet 324 (FIG. 3) of the high-pressure section 304) towards the inlet side (e.g., a side of the gears 310, 312 oriented towards the inlet 322 (FIG. 3) of the high-pressure section 304). As a result, the gears 310, 312 can help build up a pressure of the fuel between the inlet 322 and the outlet 324 of the high-pressure section 304.

In FIG. 5, the first gear shaft 502 includes a first portion 514 (e.g., a first outboard portion with respect to the first gear 310), a second portion 516 (e.g., an inboard portion with respect to the first gear 310), and a third portion 518 (e.g., a second outboard portion with respect to the first gear 310). Accordingly, the second portion 516 is positioned between the first portion 514 and the third portion 518. In FIG. 5, the first gear 310 extends radially outward from the second portion 516 of the first gear shaft 502. As such, the second portion 516 is positioned between the first portion 514 and the first gear 310. Similarly, the second portion 516 separates the third portion 518 and the first gear 310.

In FIG. 5, the second portion 516 of the first gear shaft 502 is defined by tapers 520 that diminish a thickness of the second portion 516 relative to the first portion 514 and the third portion 518. For example, the tapers 520 can be formed in the first gear shaft 502 via machining. As a result, the second portion 516 defines taper angles θ of at least about 2°, for example. For example, the taper angles θ can be between about 2° and about 20°. In turn, an angular displacement of the first gear 310 relative to the second portion 516 of the first gear shaft 502 at an interface between the first gear 310 and the first gear shaft 502 can be less than about 90°. For example, the angular displacement of the first gear 310 relative to the second portion 516 of the first gear shaft 502 can be between about 88° and about 70°. In some examples, the angular displacement of the first gear 310 relative to the second portion 516 of the first gear shaft 502 is about 90°. For example, the second portion 516 of the first gear shaft 502 can include a uniform thickness between the first gear 310 and ends of the tapers 520 such that the first gear shaft 502 is substantially perpendicular to the first gear 310 at the interface between the first gear 310 and the first gear shaft 502. In some examples, the tapers 520 include curvature as opposed to being linear or straight. Specifically, the tapers 520 define a change in thickness in the first gear shaft 502 and the second gear shaft 508 in any shape or geometry that can accommodate deflection of the first gear shaft 502 and the second gear shaft 508 while helping the shaft 502, 508 avoid contact with the bearings 504, 506, 510, 512.

In FIG. 5, along at least a portion of the shafts 502, 508, the respective thicknesses of the shafts 502, 508 can be inversely proportional to a separation or distance from the respective gears 310, 312. In turn, when the first gear 310 and/or the second gear 312 deflects in response to encountering a higher pressure on the outlet side, the first gear shaft 502 and/or the second gear shaft 508 can encounter bending proximate the respective gears 310, 312 while avoiding contact with the bearings 504, 506, 510, 512.

During operations, as a result of the built-up pressure on the outlet side of the gears 310, 312, the gears 310, 312 can encounter deflection. Specifically, the pressure difference between the outlet side and the inlet side can displace the gears 310, 312 away from the outlet 324 (FIG. 3). In FIG. 5, the tapers 520 prevent such a deflection from causing the first gear shaft 502 and/or the second gear shaft 508 to contact the respective bearings 504, 506, 510, 512. Specifically, the tapers 520 form a reduced thickness in portions of the shafts 502, 508 near the gears 310, 312 (e.g., the second portion 516 of the first gear shaft 502) to increase separation from the bearings 504, 506, 510, 512 and, thus, enable the shafts 502 to encounter bending while avoiding contact with the bearings 504, 506, 510, 512. In particular, the tapers 520 cause the first portion 514 and the third portion 518 of the first gear shaft 502 to have a first thickness T1 while the second portion 516 has a second thickness T2 smaller than the first thickness T1.

In FIG. 5, the first bearing 504 and the second bearing 506 can include inner diameters greater than the first thickness T1. As shown in FIG. 5, the bearings 504, 506, 510, 512 include a uniform inner diameter. As such, the first portion 514 and the second portion 516 of the first gear shaft 502 define a non-uniform separation distance between the first gear shaft 502 and the first bearing 504. Similarly, the second portion 516 and the third portion 518 of the first gear shaft 502 define a non-uniform separation distance between the first gear shaft 502 and the second bearing 506. Specifically, the first portion 514 and the third portion 518 of the first gear shaft 502 can be radially separated from the first bearing 504 and the second bearing 506, respectively, by a first distance.

As the bearings 504, 506, 510, 512 do not include rotating or rolling elements, lubrication enables the shafts 502, 508 to rotate in the bearings 504, 506, 510, 512 and the respective shafts 502, 508 while avoiding friction that would otherwise damage and/or cause a failure in the fuel pump 300. In FIG. 5 the bearings 504, 506, 510, 512 include fluid passages 522 to induce fuel between the bearings 504, 506, 510, 512 and the shafts 502, 508. In turn, the fuel can develop a fluid film, which builds up to provide lubrication that enables the shafts 502, 508 to rotate within the bearings 504, 506, 510, 512 without directly contacting the bearings 504, 506, 510, 512. For example, a layer of the fluid film can span the first distance between the first portion 514 and the first bearing 504 and the third portion 518 and the second bearing 506. Further, because the second portion 516 of the first gear shaft 502 is radially separated from the first bearing 504 and the second bearing 506 by at least a second distance that is greater than the first distance, a thicker layer of the fluid film and/or another fluid, such as the fuel or air, can span the second distance between the second portion 516 of the first gear shaft 502 and the first and second bearings 504, 506. As a result, the lubrication prevents metal-on-metal contact between the shafts 502, 508 and the bearings 504, 506, 510, 512 that would otherwise cause a failure in the fuel pump 300.

In the illustrated example of FIG. 5, the second gear shaft 508 includes the tapers 520 that define a non-uniform thickness, similar to the first gear shaft 502, which enables the second gear 312 to encounter deflection while helping prevent metal-on-metal contact between the second gear shaft 508 and the third and fourth bearings 510, 512.

Although the first gear shaft 502 and the second gear shaft 508 of the illustrated example include the tapers 520, it should be understood that the first gear shaft 502 and the second gear shaft 508 can include a sharper change from the first thickness T1 to the second thickness T2. For example, an interface between the first portion 514 and the second portion 516 can be substantially perpendicular, or greater than or equal to 45°, such that the second portion 516 of the first gear shaft 502 can include the second thickness T2 throughout an increased length. Similarly, an interface between the third portion 518 and the second portion 516 can be substantially perpendicular or greater than or equal to 45°.

Figure 6:
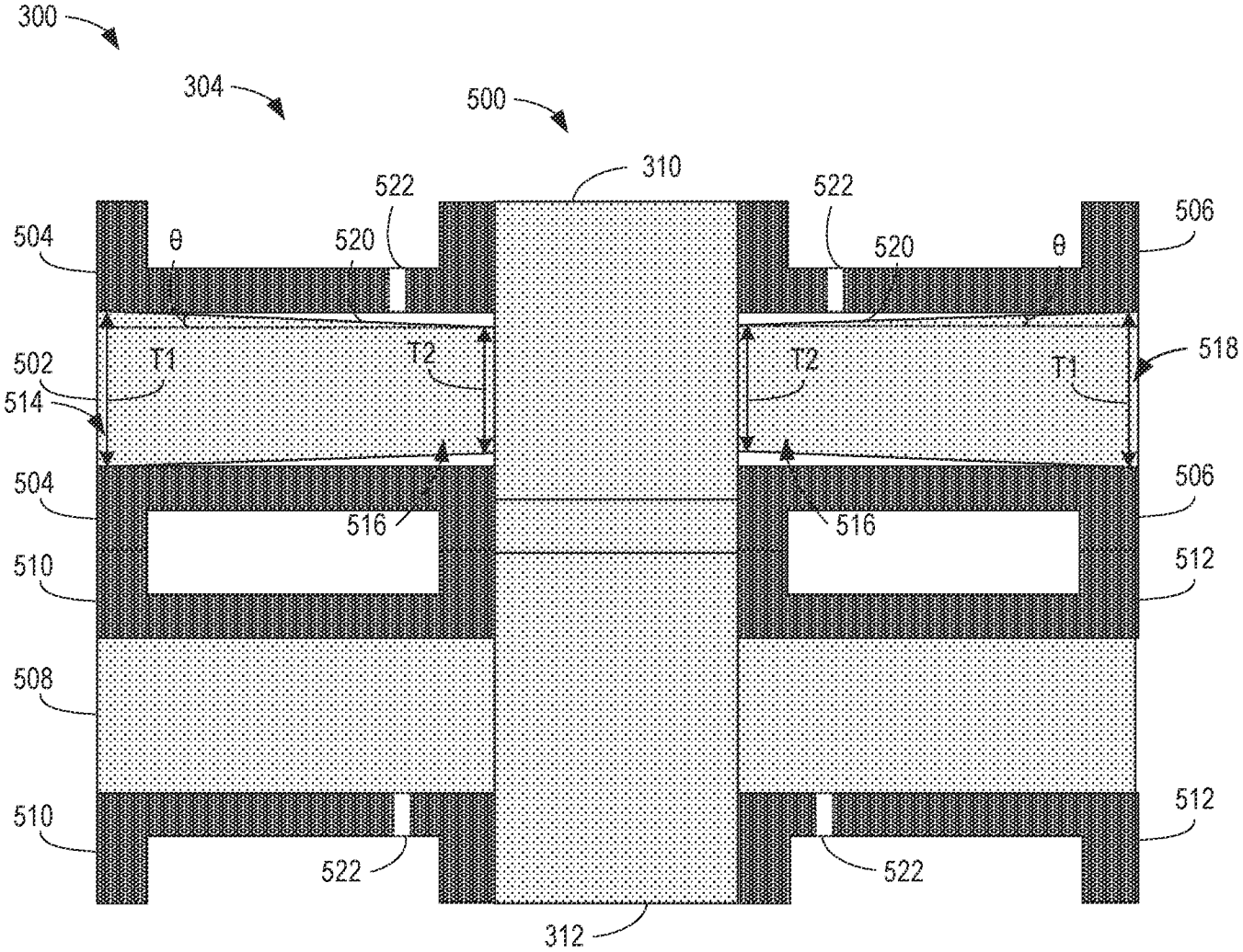
FIG. 6 illustrates another example implementation of the gear system of the fuel pump of FIGS. 3-4 in accordance with the teachings disclosed herein.

In some examples, the second gear 312 encounters a lower pressure than the first gear 310 and, thus, less deflection. In some such examples, the second gear shaft 508 can include reduced taper angles compared to the taper angles θ of the first gear shaft 502. In some other such examples, the second gear shaft 508 can include a uniform thickness, as shown in FIG. 6. Accordingly, in FIG. 6, the second gear shaft 508 can reduce manufacturing complexities and/or costs associated with causing the second gear shaft 508 to be tapered.

In some examples, the fuel pump 300 includes means for moving fluid. For example, the means for moving fluid may be implemented by the first gear 310, the second gear 312, a vane, a screw, etc.

In some examples, the fuel pump 300 includes means for bearing. For example, the means for bearing may be implemented by the first bearing 504, the second bearing 506, the third bearing 510, and/or the fourth bearing 512.

In some examples, the fuel pump 300 includes means for positioning the means for moving fluid. For example, the means for transferring torque may be implemented by the first gear shaft 502 and/or the second gear shaft 508.

In some examples, the means for positioning includes means for separating from the means for bearing. For example, the means for separating may be implemented by the tapers 520 defining the second portion 516 of the first gear shaft 502. More generally, the means for separating may be implemented by an inboard portion of the first gear shaft 502 with respect to the first gear 310 having a reduced thickness compared to an outboard portion of the first gear shaft 502 with respect to the first gear 310.

In some examples, the fuel pump 300 includes means for lubricating an interface between the means for positioning and the means for bearing. For example, the means for lubricating may be implemented by fuel that develops into a fluid film in response to being conveyed through the fluid passages 522 in the bearings 504, 506, 510, 512.

From the foregoing, it will be appreciated that example systems, methods, apparatus, and articles of manufacture have been disclosed that utilize tapered shafts positioned in bearings (e.g., journals) to enable fluid pumps to operate at higher pressures (e.g., pressures over 2,000 PSI). For example, a taper in a journal of a rotating element, such as a gear, a vane, a screw, etc., can enable the rotating element to encounter deflection. Specifically, the taper in the journal can define a reduced thickness in a portion of the journal closest to the rotating element such that the portion of the journal is radially separated from a bearing by an increased distance. As such, the portion of the journal can deform in response to the deflection of the rotating element while avoiding metal-on-metal contact with the bearing, which would otherwise cause a failure in the fluid pump.

Example tapered journals for fluid pumps are disclosed herein. Further examples and combinations thereof include the following:

Example 1 includes an apparatus to pump fluid comprising a gear, and a shaft including a taper to define a first portion of the shaft having a first thickness and a second portion of the shaft having a second thickness less than the first thickness, the second portion of the shaft between the gear and the first portion of the shaft.

Example 2 includes the apparatus of any preceding clause, further including a bearing to support the shaft, the shaft positioned at least partially in the bearing, wherein the first portion of the shaft is radially separated from the bearing by a first distance and the second portion of the shaft is radially separated from the bearing by at least a second distance greater than the first distance.

Example 3 includes the apparatus of any preceding clause, further including a fluid film to span the first distance between the first portion of the shaft and the bearing.

Example 4 includes the apparatus of any preceding clause, wherein the shaft defines a taper angle of at least 2 degrees.

Example 5 includes the apparatus of any preceding clause, further including at least one impeller positioned upstream of the gear.

Example 6 includes the apparatus of any preceding clause, wherein the at least one impeller encounters a first pressure and at least a portion of the gear encounters a second pressure greater than the first pressure.

Example 7 includes the apparatus of any preceding clause, wherein the gear is a first gear and the shaft is a first shaft, further including a second gear to engage with the first gear, and a second shaft coupled to the second gear, the second shaft including a uniform thickness.

Example 8 includes the apparatus of any preceding clause, wherein the gear is a first gear, the shaft is a first shaft, and the taper is a first taper, further including a second gear to engage with the first gear, and a second shaft including a second taper to define a first portion of the second shaft having a first thickness and a second portion of the second shaft having a second thickness less than the first thickness, the second gear coupled to the second portion of the second shaft.

Example 9 includes an apparatus to pump fluid comprising at least one bearing including a uniform inner diameter, a shaft including a first portion, a second portion, and a third portion at least partially positioned in the at least one bearing, the second portion positioned between the first portion and the third portion, the first portion and the third portion including a first thickness, the second portion including a second thickness smaller than the first thickness, and a rotating element extending radially outward from the second portion of the shaft.

Example 10 includes the apparatus of any preceding clause, wherein the second portion of the shaft defines an interface between the shaft and the rotating element, wherein the interface defines an angular displacement of less than 90 degrees between the rotating element and the second portion of the shaft.

Example 11 includes the apparatus of any preceding clause, wherein the rotating element is a gear.

Example 12 includes the apparatus of any preceding clause, wherein the rotating element is a vane or a screw.

Example 13 includes the apparatus of any preceding clause, wherein the rotating element includes cogs, further including a discharge outlet, the fluid to move towards the discharge outlet between the cogs of the rotating element.

Example 14 includes the apparatus of any preceding clause, wherein the shaft is a first shaft and the rotating element is a first rotating element, further including a second shaft, a second rotating element extending radially outward from the second shaft, and a bearing between the first shaft and the second shaft, wherein the first portion of the first shaft is separated from the bearing by a first distance and the second portion of the shaft is separated from the bearing by a second distance greater than the first distance.

Example 15 includes the apparatus of any preceding clause, wherein the second shaft is parallel to the first shaft.

Example 16 includes the apparatus of any preceding clause, wherein the second portion of the shaft defines a first taper on a first side of the rotating element and a second taper on a second side of the rotating element opposite the first side.

Example 17 includes the apparatus of any preceding clause, wherein the shaft is positioned in a bearing, wherein a separation between the second portion of the shaft and the bearing is inversely proportional to a distance from the rotating element.

Example 18 includes a fluid pump comprising means for moving fluid, means for bearing, and means for positioning the means for moving the fluid to be supported by the means for bearing, the means for positioning including means for separating from the means for bearing.

Example 19 includes the fluid pump of any preceding clause, wherein the means for separating defines a non-uniform separation distance between the means for positioning and the means for bearing.

Example 20 includes the fluid pump of any preceding clause, further including means for lubricating an interface between the means for positioning and the means for bearing.

Example 21 includes the apparatus of any preceding clause, wherein the shaft is a first shaft, the rotating element is a first rotating element, and the at least one bearing is at least one first bearing, further including a second shaft including a first portion, a second portion, and a third portion at least partially positioned in at least one second bearing, the second portion positioned between the first portion and the third portion, the first portion and the third portion of the second shaft including the first thickness or a third thickness greater than the second thickness, the second portion of the second shaft including the second thickness or a fourth thickness smaller than the third thickness, and a second rotating element fixed to the second portion of the second shaft, the second rotating element to drive the first rotating element.

Example 22 includes the apparatus of any preceding clause, wherein the shaft is a first shaft, the rotating element is a first rotating element, and the at least one bearing is at least one first bearing, further including a second shaft including a first portion, a second portion, and a third portion at least partially positioned in at least one second bearing, the second portion positioned between the first portion and the third portion, the first portion, the second portion, and the third portion including a uniform thickness, and a second rotating element fixed to the second portion of the second shaft, the second rotating element to drive the first rotating element.

Example 23 includes the apparatus of any preceding clause, wherein the shaft is a first shaft, the rotating element is a first rotating element, and the at least one bearing is at least one first bearing, further including a second shaft including a first portion, a second portion, and a third portion at least partially positioned in at least one second bearing, the second portion positioned between the first portion and the third portion, the first portion, the second portion, and the third portion including a uniform thickness, and a second rotating element fixed to the second portion of the second shaft, the first rotating element to drive the second rotating element.

Example 24 includes the apparatus of any preceding clause, wherein the at least one bearing includes fluid passages to induce the fluid between the shaft and the bearing, the fluid to develop a fluid film that provides lubrication between the shaft and the at least one bearing.

Example 25 includes the apparatus of any preceding clause, wherein the first shaft includes a first rotational axis and the second shaft includes a second rotational axis substantially parallel to the first rotational axis.

Example 26 includes the apparatus of any preceding clause, wherein the shaft and the bearing are metallic.

Example 27 includes the apparatus of any preceding clause, wherein the bearing includes a fluid passage to enable fluid to form a fluid film between the bearing and the first shaft.

Example 28 includes the apparatus of any preceding clause, wherein the bearing is a first bearing, further including a second bearing between the first shaft and the second shaft, the second shaft at least partially positioned in the second bearing.

Example 29 includes the apparatus of any preceding clause, wherein the gear includes cogs, the cogs to carry the fluid towards an outlet.

The following claims are hereby incorporated into this Detailed Description by this reference. Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

What is claimed is:

1. An apparatus to pump fluid comprising:

at least one bearing including a uniform inner diameter;

a shaft including a first portion, a second portion, and a third portion at least partially positioned within the uniform inner diameter of the at least one bearing, the second portion positioned between the first portion and the third portion, the first portion and the third portion including a first thickness, the second portion including a second thickness smaller than the first thickness; and a rotating element extending radially outward from the second portion of the shaft, wherein a separation between the second portion of the shaft and the at least one bearing is inversely proportional to a distance from the second portion of the shaft to the rotating element.

2. The apparatus of claim 1, wherein the rotating element is a gear.

3. The apparatus of claim 1, wherein the rotating element is a vane or a screw.

4. The apparatus of claim 1, wherein the rotating element includes cogs, further including a discharge outlet, the fluid to move towards the discharge outlet between the cogs of the rotating element.

5. The apparatus of claim 1, wherein the second portion of the shaft defines a first taper on a first side of the rotating element and a second taper on a second side of the rotating element opposite the first side.

6. An apparatus to pump fluid comprising:

at least one bearing including a uniform inner diameter;

a shaft including a first portion, a second portion, and a third portion at least partially positioned within the uniform inner diameter of the at least one bearing, the second portion positioned between the first portion and the third portion, the first portion and the third portion including a first thickness, the second portion including a second thickness smaller than the first thickness; and a rotating element extending radially outward from the second portion of the shaft, wherein the second portion of the shaft defines an interface between the shaft and the rotating element, wherein the interface defines an angular displacement of less than 90 degrees between the rotating element and the second portion of the shaft.

7. An apparatus to pump fluid comprising:

at least one first bearing including a uniform inner diameter;

a first shaft including a first portion, a second portion, and a third portion at least partially positioned within the uniform inner diameter of the at least one first bearing, the second portion positioned between the first portion and the third portion, the first portion and the third portion including a first thickness, the second portion including a second thickness smaller than the first thickness;

a first rotating element extending radially outward from the second portion of the first shaft;

a second shaft;

a second rotating element extending radially outward from the second shaft; and at least one second bearing between the first shaft and the second shaft, wherein the first portion of the first shaft is separated from the at least one first bearing by a first distance and the second portion of the first shaft is separated from the at least one first bearing by a second distance greater than the first distance.

8. The apparatus of claim 7, wherein the second shaft is parallel to the first shaft.

9. A fluid pump comprising:

means for moving fluid;

means for bearing including fluid passageways;

means for positioning the means for moving fluid to be supported by the means for bearing, the means for positioning including means for separating from the means for bearing; and means for lubricating an interface between the means for positioning and the means for bearing, the means for lubricating conveyed to the interface through the fluid passageways of the means for bearing.

10. The fluid pump of claim 9, wherein the means for separating defines a non-uniform separation distance between the means for positioning and the means for bearing.

* * * * *